United States Patent [19]

Rudszinat et al.

[11] 3,952,865

[45] Apr. 27, 1976

[54] TRANSFER APPARATUS FOR CIGARETTES OR THE LIKE

[75] Inventors: Willy Rudszinat, Dassendorf; Dieter Schwenke, Hamburg; Werner Ringe, Geesthacht, all of Germany

[73] Assignee: Hauni-Werke Körber & Co., KG, Hamburg-Bergedorf, Germany

[22] Filed: May 17, 1974

[21] Appl. No.: 470,961

[30] Foreign Application Priority Data

May 23, 1973 Germany ..... 2326181
July 26, 1973 Germany ..... 2337945

[52] U.S. Cl. ..... 198/240; 198/20 C; 198/25

[51] Int. Cl.[2] ..... B65G 47/24

[58] Field of Search ..... 198/20 C, 25, 31 AA, 198/34, 110, 237, 238, 240; 131/25, 94; 214/1 BS

[56] References Cited

UNITED STATES PATENTS

| | | | |
|---|---|---|---|
| 2,643,778 | 6/1953 | Socke | 198/240 |
| 3,039,606 | 6/1962 | Dearsley | 198/25 UX |
| 3,303,926 | 2/1967 | Pohl | 198/25 |
| 3,372,702 | 3/1968 | Bohn et al. | 198/31 AA |
| 3,521,513 | 7/1970 | Gomann et al. | 198/25 |
| 3,567,011 | 3/1971 | Pinkham | 198/25 |
| 3,583,546 | 6/1971 | Koop | 198/240 |
| 3,664,891 | 5/1972 | Schubert et al. | 198/31 AA |

*Primary Examiner*—John J. Love
*Assistant Examiner*—Jeffrey V. Nase
*Attorney, Agent, or Firm*—Kane, Dalsimer, Kane, Sullivan and Kurucz

[57] ABSTRACT

Apparatus which transports cigarettes from a pick-up station where the cigarettes move axially one behind the other to a delivery station where the cigarettes move sideways in one or more rows has one or more carriers which rotate about a horizontal or vertical axis and carry pick-up heads for cigarettes. The carriers are rotatable with as well as relative to a disk which is driven at a constant speed so that the heads move at a high speed during travel past the pick-up station and at a lower speed during movement past the delivery station. The mechanism for moving the carriers relative to the disk includes mating oval gears or bell crank levers which are pivotably mounted on the disk and are coupled to their carriers by means of links. The bell crank levers have followers which track a stationary cam. The carriers may constitute levers which are articulately mounted on a turret rotating in a horizontal plane in response to rotation of holder which moves the turret by means of several crank units. The upper ends of the levers are pivoted to the lower crank pins of the respective crank units and their lower ends carry the pick-up heads. Cams on the turret cause the levers to pivot toward the axis of the turret during movement toward the pick-up station and away from the axis of the turret during movement toward the delivery station. The crank units orient the heads so as to maintain each head in alignment with cigarettes at either station. Analogous orienting devices are provided for the rotating carriers.

35 Claims, 12 Drawing Figures

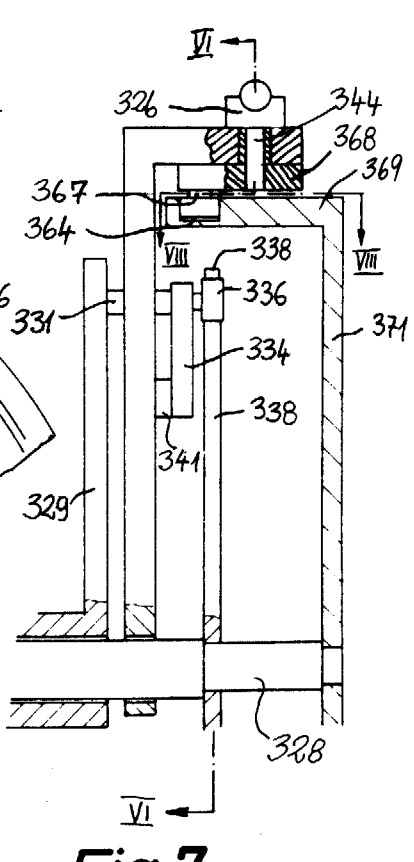
Fig.7
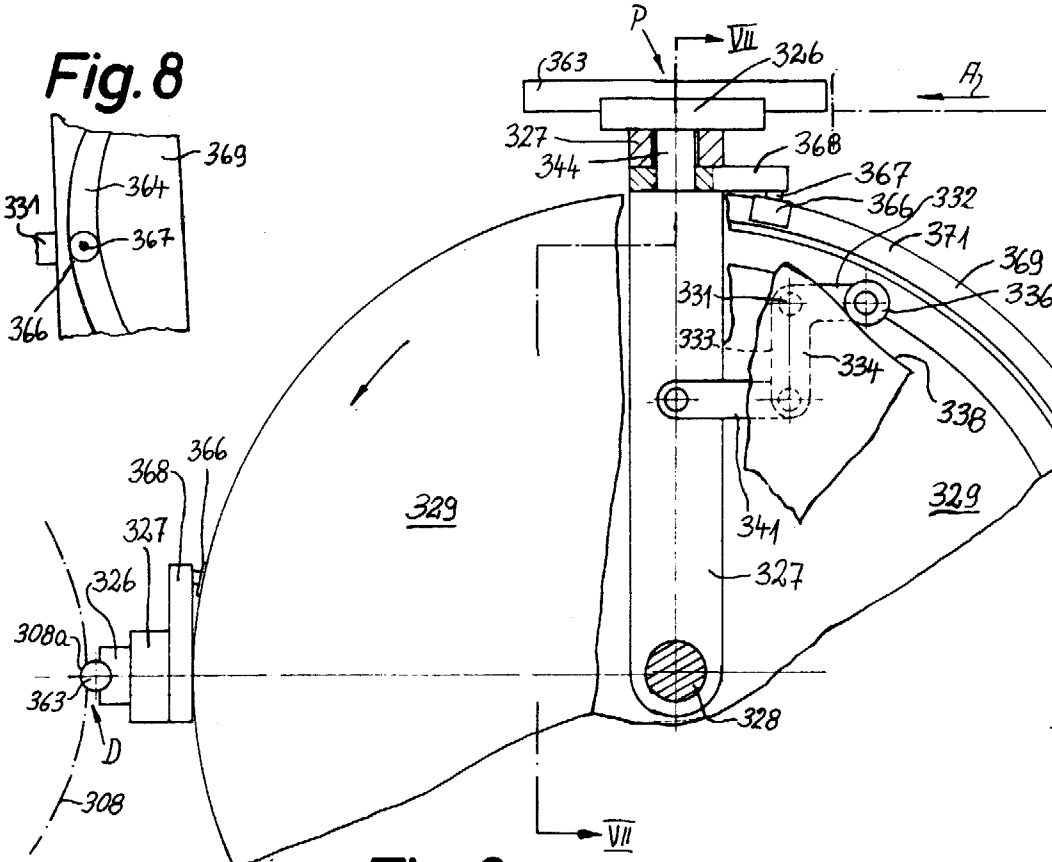
Fig.6
Fig.8

TRANSFER APPARATUS FOR CIGARETTES OR THE LIKE

BACKGROUND OF THE INVENTION

The present invention relates to improvements in apparatus for transporting cigarettes, cigars, cigarillos, filter rod sections or analogous articles which form part of or constitute rod-shaped smokers' products. More particularly, the invention relates to improvements in apparatus for transferring rod-shaped articles (hereinafter called cigarettes for short) between a station where the articles move lengthwise in a single file and a station where the articles move sideways and form one or more rows.

It is already known to utilize in or with a cigarette rod making machine a transfer apparatus which converts a single file of plain cigarettes issuing from the machine into one or more rows wherein the cigarettes move sideways, e.g., into or through a filter cigarette making machine. The cigarette rod making machine can produce up to and in excess of 70 plain cigarettes per second, and the single file of cigarettes issuing from such machine is normally converted into two rows wherein each cigarette of one row is coaxial with and spaced apart from a cigarette of the other row so as to provide room for insertion of a filter rod section of double unit length. The aligned cigarettes are thereupon connected to the filter rod section therebetween by an adhesive-coated uniting band which is convoluted around the filter rod section and the adjacent inner end portions of the respective plain cigarettes to form therewith a filter cigarette of double unit length. The latter is thereupon processed in the customary way, i.e., it is severed to yield two filter cigarettes of unit length, one of the thus obtained cigarettes of unit length is turned end-for-end and the cigarettes are thereupon tested prior to introduction into storage or directly into a packing machine.

As a rule, the speed of cigarettes which form the two rows of cigarettes in a filter cigarette making machine is less than the speed of lengthwise movement of the single file of plain cigarettes at the discharge end of a cigarette rod making machine. Therefore, the apparatus which transfers cigarettes from the cigarette rod making machine to the filter cigarette making machine must pick up successive plain cigarettes or pairs of coaxial cigarettes at a high speed and deposit the picked up cigarettes onto a drum, belt conveyor or an analogous transporting device on which the cigarettes move sideways at a lower speed. A transfer apparatus which can perform such function is disclosed in U.S. Pat. No. 3,303,926 to Pohl. The patented apparatus uses a set of planetary units which orbit about a stationary sun gear and carry eccentric crank pins for pneumatic pick-up heads. The heads travel along an epicycloidal path and are oriented by means of additional gears so that each thereof is parallel with the cigarettes of the single file at the pick-up station and with the flutes or like receiving means of a conveyor at a delivery station. The conveyor transports the cigarettes sideways. The apparatus of Pohl exhibits a number of drawbacks, especially as regards its complexity, proneness to malfunction, and noise level. Moreover, the mass of moving parts is so great that the apparatus operates properly only up to a certain speed which is less than that necessary to accept the entire output of a modern high-speed cigarette rod making machine. The planetary units and the orienting gears for the pick-up heads must be constructed and assembled with an extremely high degree of precision, and all moving parts must be mounted in expensive bearings.

SUMMARY OF THE INVENTION

An object of the invention is to provide a transfer apparatus which is simpler than heretofore known apparatus, which generates less noise than conventional transfer apparatus, which consists of simple and rugged parts, and which can be used to transfer cigarettes or analogous rod-shaped articles from a station to which the articles are fed by moving sidewise to a station where the articles move lengthwise, or vice versa.

Another object of the invention is to provide a transfer apparatus which can change the speed of articles during transfer from one to the other station so as to insure reliable removal of all articles which are fed to the pick-up station and accurate positioning of picked up articles at the delivery station.

A further object of the invention is to provide a transfer apparatus whose operation is just as reliable within a lower speed range as within a medium- or high-speed range and which can be used with particular advantage to transport cigarettes or the like between one or more producing machines and one or more consuming machines, especially from a cigarette rod making machine to a filter cigarette making machine.

An additional object of the invention is to provide a transfer apparatus which can transport groups of coaxial articles and can automatically change the spacing between the picked up articles during transport to the delivery station.

In accordance with a first feature of the invention, the apparatus for transferring cigarettes or analogous rod-shaped articles between first and second stations where the articles respectively move lengthwise in a single file and sideways in at least one row comprises at least one carrier which is rotatable in a horizontal, vertical or otherwise inclined plane about a predetermined axis, a pick-up device which is movably (preferably rotatably) mounted on the carrier at a point remote from the predetermined axis to travel past the two stations along a circular path in response to rotation of the carrier, orienting means for moving the pick-up device relative to the carrier while the carrier rotates to thereby respectively align the pick-up device with at least one article at the first station or with at least one article at the second station so that the device can respectively pick up articles at one station and deliver the picked up articles to the other station, and means for rotating the carrier at a plurality of speeds including first and second speeds while the pick-up device respectively moves past the first and second stations.

If the pick-up device is rotatable relative to its carrier, it rotates about a second axis which is located at a fixed distance from the predetermined axis. The second axis can be parallel or normal to the predetermined axis.

The means for rotating the carrier may comprise a rotary driving member (e.g., a disk which is coaxial with the carrier), means for rotating the driving member at a predetermined speed (normally at a constant speed), and means for driving the carrier at the aforementioned plurality of speeds in response to rotation of the driving member at the predetermined speed.

In accordance with a second feature of the invention, the transfer apparatus comprises a holder which is rotatable about a predetermined axis in a predetermined plane (e.g., in a horizontal plane), at least one lever or an analogous carrier which is movable by the holder so that one of its ends performs a circular movement, coupling means for mounting the one end of the carrier for pivotal movement about an axis which is parallel to the plane of rotary movement of the holder and is located at a fixed distance from the center of the circle described by the one end, a pick-up head at the other end of the carrier, means for rotating the holder at a predetermined speed, means for pivoting the carrier about the second axis in synchronism with rotation of the holder to thereby move the head along an endless path (preferably an oval path) extending past the first and second stations, and orienting means for maintaining the pick-up head in parallelism with at least one article at the first station or with at least one article at the second station so that the head can pick up articles at one of the stations and deliver the picked up articles to the other station.

In each embodiment of the invention, the pick-up head can transport articles from the second station to the first station or vice versa. When the apparatus is installed at the discharge end of a cigarette rod making or filter rod making machine, the pick-up head delivers articles (plain cigarettes or filter rod sections) from the first station (where the articles move lengthwise) to the second station.

The novel features which are considered as characteristic of the invention are set forth in particular in the appended claims. The improved transfer apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 6 is a fragmentary partly front elevational and partly vertical sectional view of a fourth transfer apparatus, the section being taken along the line VI—VI of FIG. 7;

FIG. 7 is a sectional view as seen in the direction of arrows from the line VII—VII of FIG. 6;

FIG. 8 is a fragmentary detail view as seen in the direction of arrows from the line VIII—VIII of FIG. 7;

DESCRIPTION OF THE PREFERRED EMBODIMENTS

Figure 1:
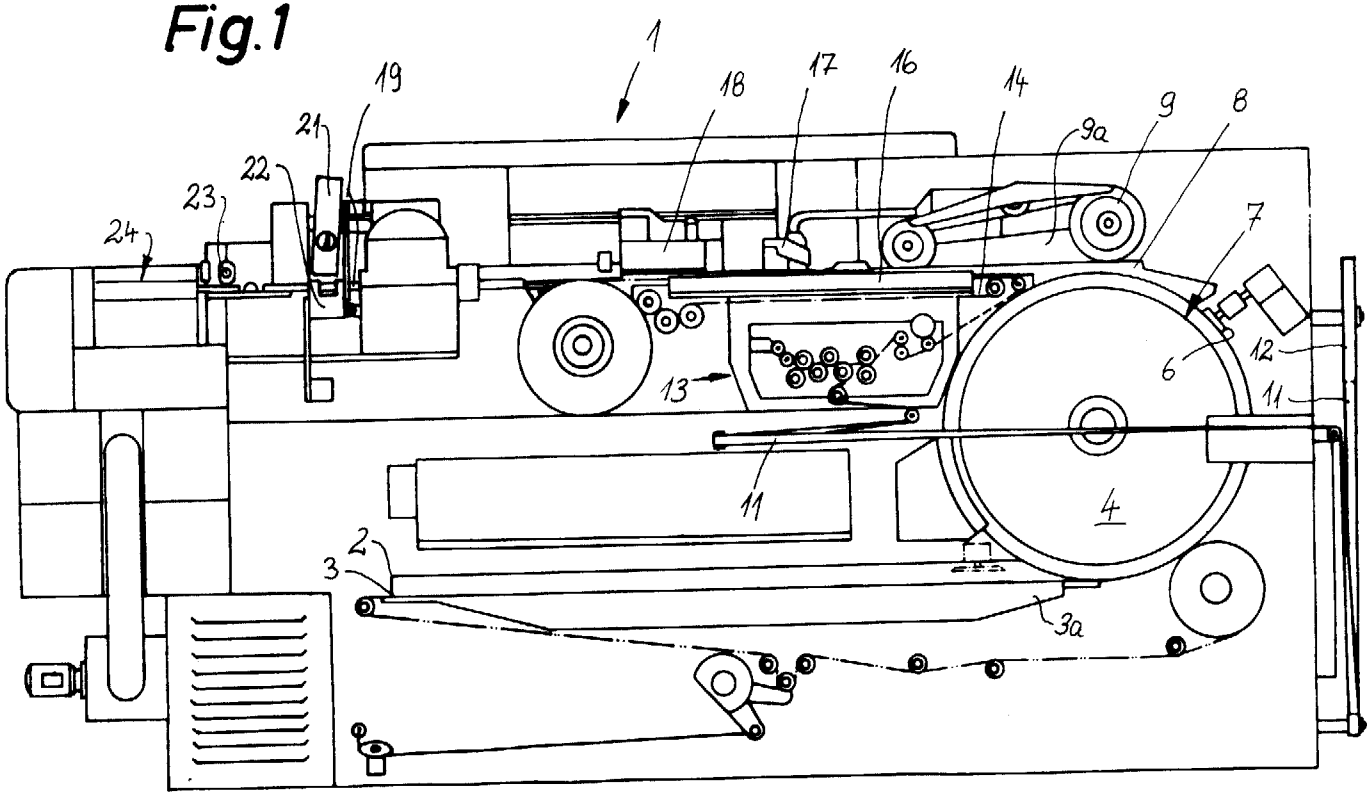
FIG. 1 is a schematic elevational view of a cigarette rod making machine which delivers a single file of plain cigarettes to a pick-up station where the cigarettes are taken over and transported to a delivery station by a transfer apparatus which embodies one form of the invention.

FIG. 1 shows a cigarette rod making machine which embodies or is combined with one form of the improved transfer apparatus. The cigarette rod making machine is of the type known as GARANT (produced by Hauni-Werke, Körber & Co. KG, Hamburg-Bergedorf, Western Germany) and comprises a distributor 1 which showers tobacco shreds into an elongated tobacco channel 2 wherein the particles descend onto the upper stretch of a narrow endless belt conveyor 3. The upper stretch of the conveyor 3 transports the growing tobacco stream in a direction to the right, as viewed in FIG. 1, and introduces successive increments of the fully grown stream into the circumferential groove of a suction wheel 4. The bottom wall in the groove of the wheel 4 is foraminous and travels about a stationary suction chamber (not specifically shown) which attracts the tobacco stream to the bottom wall while the stream travels toward a trimming or equalizing device 6 which removes the surplus and thus converts the stream into a rod-like filler 7. Another suction chamber 3*a* is mounted below and has an open upper end facing the upper stretch of the conveyor 3, and the latter is permeable to air so that tobacco shreds which are showered by the distributor 1 are compelled to travel with the upper stretch of the conveyor 3 toward the transfer station between this conveyor and the suction wheel 4.

The filler 7 is expelled from the groove of the suction wheel 4 by a tongue 8 and is attracted to the lower stretch of an endless perforated belt 9 which serves to transfer the filler onto a further endless belt conveyor 14 known as garniture tape. The lower stretch of the belt 9 travels below the open underside of a stationary suction chamber 9*a*.

The upper stretch of the garniture tape 14 transports a web 11 of cigarette paper which is being withdrawn from a bobbin 12 and passes through an imprinting mechanism 13 which provides spaced-apart portions of the web with information, such as the brand name of the cigarettes, the name of the manufacturer, and/or others. A wrapping mechanism 16 which is adjacent to the upper stretch of the garniture tape 14 converts the web 11 into a tubular wrapper which surrounds the filler 7 and forms therewith a continuous cigarette rod 19. A first or front portion of the wrapping mechanism 16 includes means for draping the web 11 about the filler 7 in such a way that one marginal portion of the web extends upwardly and can be coated with adhesive by a paster 17. A second or rear portion of the wrapping mechanism 16 thereupon folds the adhesive-coated marginal portion of the web 11 over the other marginal portion so that the two marginal portions form a longitudinally extending seam which is heated by a sealer 18 serving to cause rapid setting of adhesive.

The cigarette rod 19 passes through a guide 22 which is adjacent to a cutoff 21 serving to sever and subdivide the rod into plain cigarettes of desired length, preferably into cigarettes of unit length. Successive cigarettes may but need not be accelerated by a rapidly rotating cam 23 which propels them into the range of a transfer apparatus 24 constructed and assembled in accordance with one embodiment of the invention. The purpose of the transfer apparatus 24 is to convert the single file of cigarettes issuing from the machine of FIG. 1 into one or more rows of cigarettes which move sideways and can be processed in a further machine or introduced into storage. For example, the transfer apparatus 24 may serve to convert the single file of axially moving cigarettes which advance past the cam 23 into two rows of cigarettes which move sideways and wherein each cigarette of one row is in axial alignment with a cigarette of the other row. Such pairs of aligned cigarettes can be combined with filter plugs of double unit length to form therewith filter cigarettes of double unit length each of which is thereupon severed midway between its ends to yield two filter cigarettes of unit length.

In addition to changing the direction of movement of cigarettes from axial to sidewise, the transfer apparatus 24 can perform one or more additional functions, especially that of changing the speed of cigarettes during transfer so that the pairs of axially aligned cigarettes enter the filter cigarette making machine at a given speed which may but need not equal the speed of lengthwise movement of plain cigarettes through the guide 22 and/or past the accelerating cam 23. As a rule, the speed of sidewise movement of plain cigarettes in a filter cigarette making machine is less than the speed of lengthwise movement of plain cigarettes at the discharge end of a cigarette rod making machine.

Figure 2:
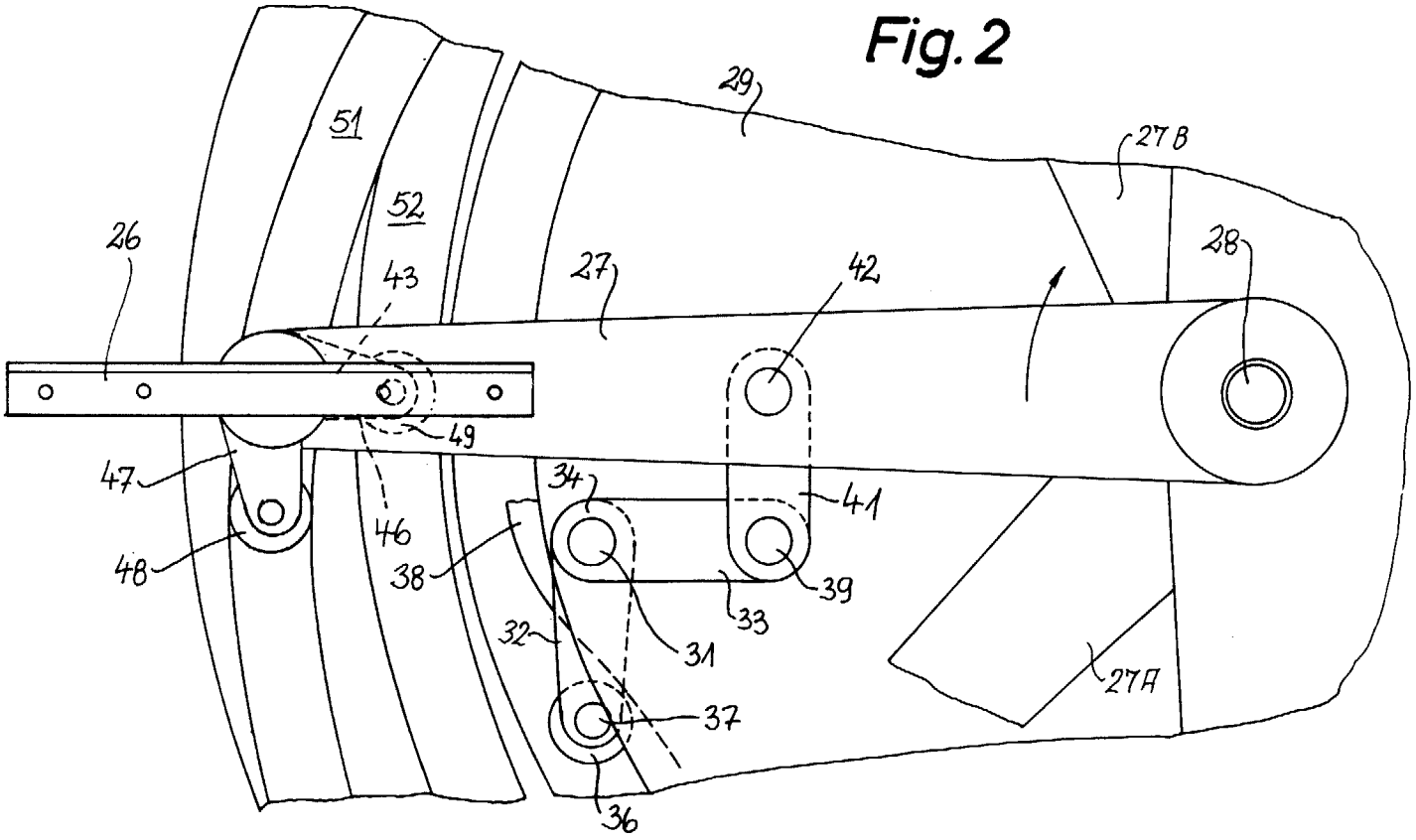
FIG. 2 is an enlarged fragmentary top plan view of the transfer apparatus of FIG. 1.
Figures 3, 5:
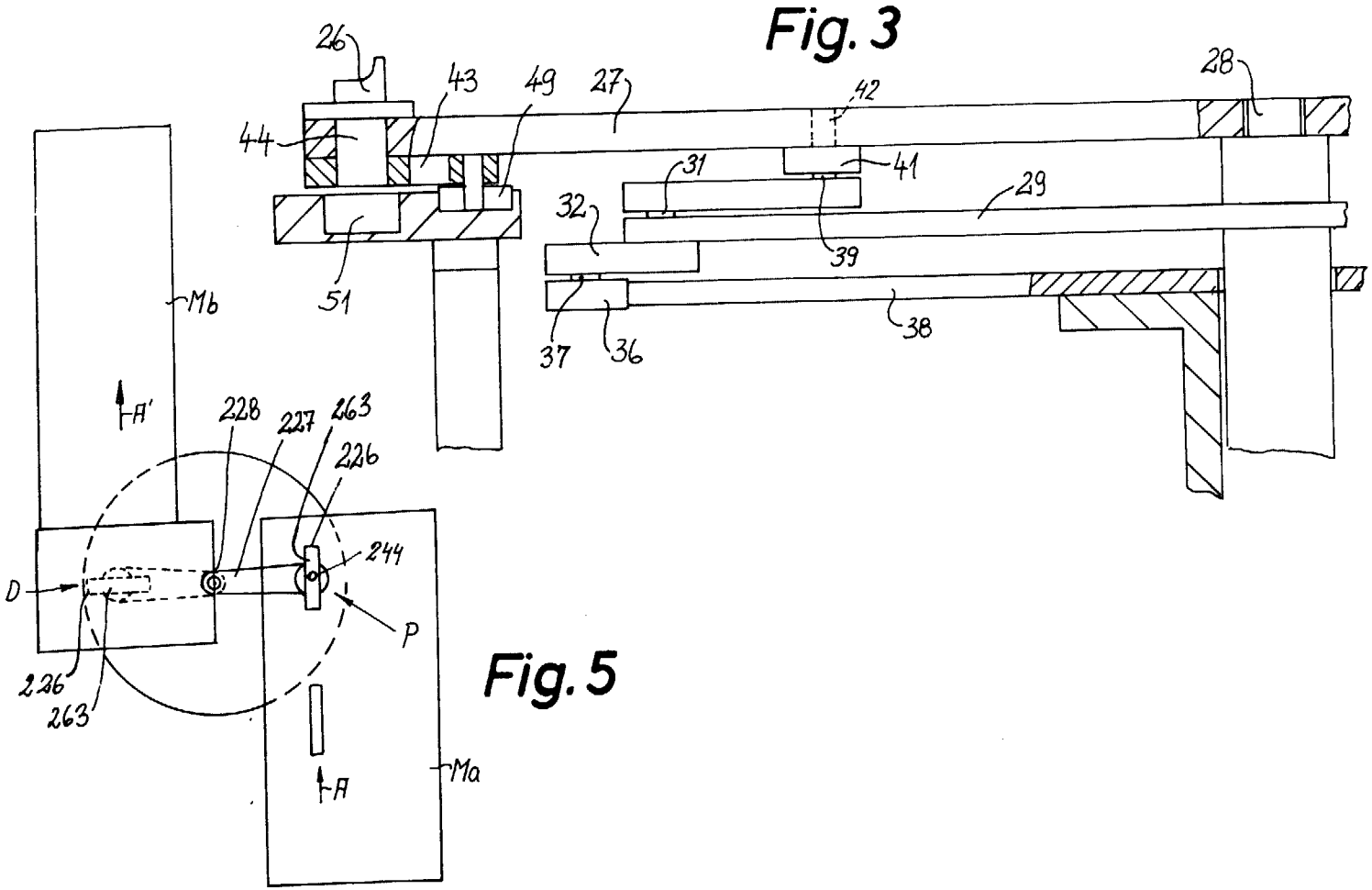
FIG. 3 is a fragmentary partly side elevational and partly vertical sectional view of the structure shown in FIG. 2.
FIG. 5 is a schematic plan view of a third transfer apparatus.

Certain details of the transfer apparatus 24 are shown in FIGS. 2 and 3. This apparatus comprises at least one receiving means in the form of a cigarette pick-up device or head 26 mounted at the outer end of a lightweight elongated one-armed carrier 27. The other end of the carrier 27 is rotatably mounted on a vertical shaft 28 which is journalled in the frame of the cigarette rod making machine. The means for rotating the carrier 27 about the axis of the shaft 28 comprises a rotary disk-shaped driving member 29 (hereinafter called disk) which is coaxial with and may be driven by the shaft 28 so as to rotate at a predetermined (normally constant) speed in synchronism with the speed of the prime mover for the cigarette rod making machine. The disk 29 carries an eccentrically mounted turnable pin 31 which is rigid with a two-piece bell crank lever 34 forming part of a motion transmitting unit for the carrier 27. The arm 33 of the bell crank lever 34 is located at one side of the disk 29 and is articulately connected with one end of a link 41 by means of a pivot pin 39. The other end of the link 41 is articulately connected with an intermediate portion of the carrier 27 by a further pivot pin 42. The link 42 constitutes a second part of the motion transmitting unit for the carrier 27. The arm 32 of the bell crank lever 34 is located at the other side of the disk 29 and carries a pin 37 for a roller follower 36 which tracks the peripheral surface of a stationary cam 38. The axes of the parts 37, 31, 39, 42 are parallel to the axis of the shaft 28. The peripheral surface of the cam 38 includes at least one portion which is located at a maximum distance from the axis of the shaft 28. Thus, as the roller follower 36 tracks the peripheral surface of the cam 38, it causes the bell crank lever 34 to turn about the axis of the pin 31 whereby the link 41 causes the pin 42 to move the carrier arm 27 relative to the rotating disk 29. It will be seen that the means for rotating the carrier 27 at a plurality of speeds includes the driving member or disk 29, means (shaft 28) for driving the disk 29 at a predetermined speed, and means 34, 36, 38, 41 for driving the carrier at several speeds during each revolution of the disk 29. The last mentioned means includes the motion transmitting unit 34, 41 whose lever 34 is eccentrically mounted on the disk 29 (see the pin 31) and means 36, 38 for moving the unit 34, 41 relative to the disk 29.

The means for movably connecting the pick-up device or head 26 of the transfer apparatus 24 to the carrier 27 comprises shaft 44 which is rigid with a median portion of the head 26 and forms part of an orienting means 43 which serves to control the orientation of the head 26 during movement of the head 26 along a circular path which is located in a horizontal plane and whose center is located on the axis of the shaft 28. The orienting means 43 further comprises two legs 46, 47 which are rigid with the shaft 44 and respectively carry roller followers 49, 48. The roller follower 48 extends into the endless groove of a first guide means or track 51 and the roller follower 49 extends into the endless groove of a second guide means or track 52. The grooves of the tracks 51, 52 overlap each other in part (see the upper portion of FIG. 2) and insure that the orientation of the head 26 remains unchanged while the carrier 27 rotates about the axis of the shaft 28 at a varying speed which is determined by the disk 29 and by the cam 38 which latter controls angular movements of the bell crank lever 34 about the axis of the pin 31. The axis of the shaft 44 is parallel to the axis of the shaft 28 and the orienting means rotates the head 26 about the axis of the shaft 44 while the carrier 27 rotates about the axis of the shaft 28. It will be noted that the head 26 is remote from the shaft 28 and the roller followers 48, 49 are spaced apart from the axis of the shaft 44.

The operation of the transfer apparatus 24 is as follows:

When the disk 29 is set in motion, the carrier 27 begins to travel about the axis of the shaft 28 under the action of the link 41 which receives motion from the bell crank lever 34. The latter receives motion from the disk 29 through the medium of the pivot pin 31. Were it not for the cam 38, the carrier 27 would rotate at the exact speed of the disk 29; however, and since the peripheral surface of the cam 38 which is tracked by the roller follower 36 has at least one hill or lobe and at least one valley, the carrier 27 lags behind the disk 29 when the roller follower 36 tracks a lobe and the carrier 27 moves ahead of the disk 29 when the roller follower 36 travels in a valley of the cam 38. Thus, and assuming that the disk 29 is rotated clockwise, as viewed in FIG. 2, the carrier 27 travels clockwise about the axis of the shaft 28 but simultaneously moves counterclockwise with respect to the disk 29 when the roller follower 36 tracks a lobe of the cam 38. Inversely, the carrier 27 moves clockwise with respect to the disk 29 when the roller follower 36 moves in a valley of the peripheral surface of the cam 38.

When the cam 38 causes the roller follower 36 to move radially of and away from the axis of the shaft 28, the bell crank lever 34 turns about the axis of the pin 31 (clockwise, as viewed in FIG. 2) and causes the link 41 to pull the carrier 27 counterclockwise with respect to the disk 29. In other words, the arm 33 of the bell crank lever 34 tends to move the pin 39 away from the carrier 27 but the link 41 prevents such movement of the pin 39 and entrains the carrier counterclockwise with respect to the disk 29 (while the carrier continues to rotate clockwise about the axis of the shaft 28). This results in a slowing-down of the head 26 with one or more plain cigarettes therein.

When the roller follower 36 reaches the crest of a lobe on the peripheral surface of the cam 38, it begins to move radially inwardly toward the axis of the shaft 28. The bell crank lever 34 then turns counterclockwise about the axis of the pin 31 and pushes the pin 39 toward the carrier 27 whereby the link 41 moves the carrier 27 clockwise with respect to the disk 29 (while the carrier continues to turn clockwise about the axis of the shaft 28) so that the head 26 is accelerated.

The transfer apparatus 24 may comprise two or more one-armed carriers, an equal number of pick-up devices or heads, and an equal number of bell crank levers and orienting means, one for each head. FIG. 2 shows portions of two additional one-armed carriers 27A and 27B. For example, the shaft 28 can support eight carriers which are equally spaced from each other and rotate in parallel planes. All of the roller followers 36 can track one and the same cam 38, and all of the roller followers 49, 48 can respectively travel in the grooves of the tracks 52, 51.

Successive heads 26 pick up single plain cigarettes or pairs of aligned plain cigarettes while moving rapidly past a pick-up station forming part of the path of the single file of plain cigarettes downstream of the accelerating cam 23 of FIG. 1, and such single cigarettes or pairs of aligned cigarettes are released by successive heads 26 during travel at a lower speed past a delivery station, not shown, where the cigarettes descend onto or enter into and move sideways with a drum-shaped, belt-shaped or otherwise configurated conveyor of a filter cigarette making machine.

If the transfer apparatus 24 employs an even number of carriers 27, each of these carriers can be made rigid with the aligned carrier and each such pair of aligned carriers can be coupled with a single bell crank lever 34, provided that the peripheral surface of the cam 38 has two lobes which are located diametrically opposite each other. If the cam 38 has a single lobe, each carrier 27 is coupled to a discrete bell crank lever 34 and each carrier 27 is then movable angularly with respect to all other carriers.

It is further clear that the improved transfer apparatus can be used to convert one or more rows of cigarettes or other rod-shaped articles which move sideways into a single file of cigarettes which move lengthwise. This would merely involve the provision of means which causes the device or devices 26 to pick-up successive cigarettes of one or more rows of moving cigarettes and to deposit the picked up cigarettes into a path wherein the cigarettes are moved lengthwise.

Figure 4:
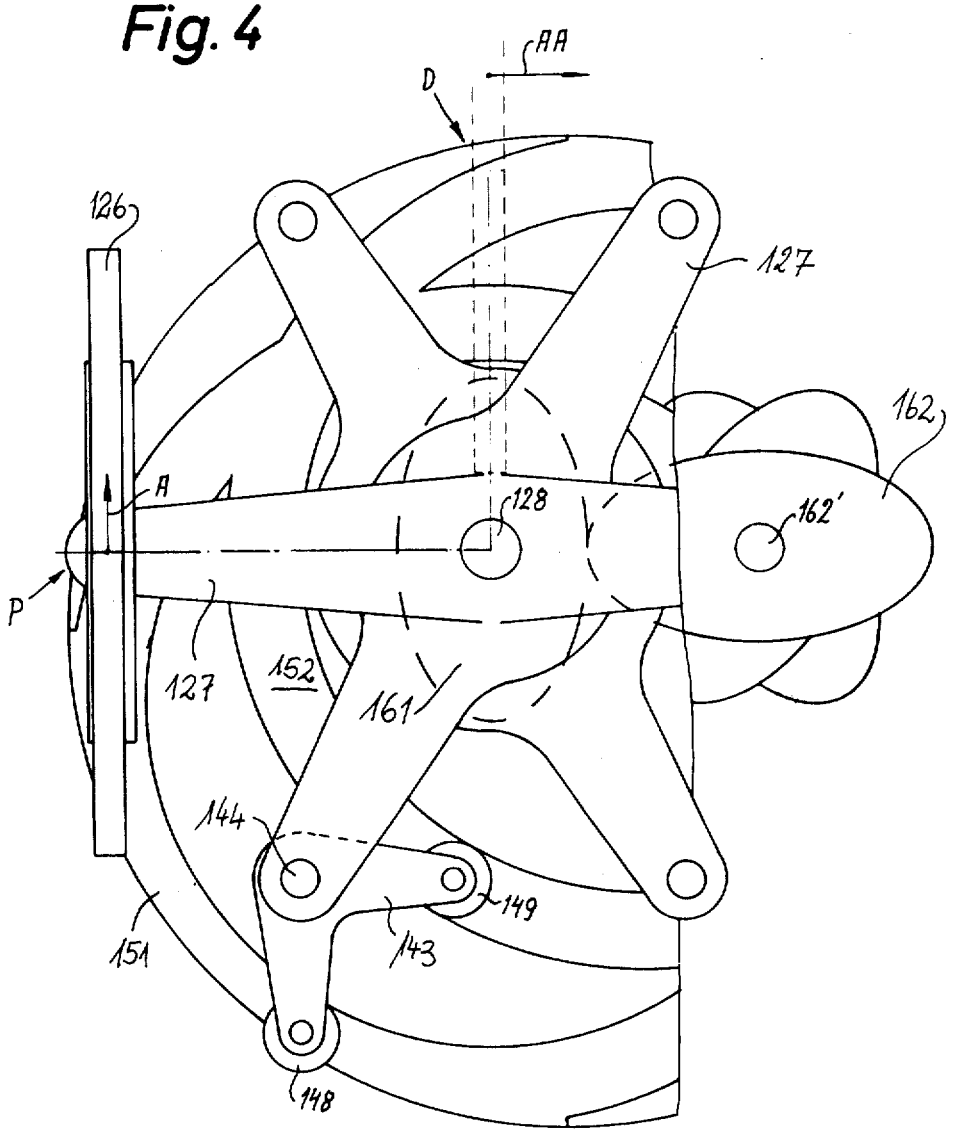
FIG. 4 is a fragmentary plan view of a second transfer apparatus.

FIG. 4 shows a portion of a second transfer apparatus with six carriers 127 each of which supports a pick-up device or head 126 long enough to support a pair of coaxial plain cigarettes of unit length. The shaft for the carriers 127 is shown at 128. The orienting means 143 for the heads 126 are analogous to the orienting means 43 of FIGS. 2–3 and their parts are denoted by similar reference characters plus 100. Each carrier 127 is rigid with an elliptical gear or oval gear 161 mating with a complementary elliptical or oval gear 162 on a drive shaft 162'. The angular positions of mating elliptical gears 161, 162 are such that the minor axis of the gear 161 is aligned with the major axis of the gear 162 when the head 126 picks up a pair of cigarettes at the discharge end of the cigarette rod making machine, and that the major axis of the gear 161 is aligned with the minor axis of the gear 162 when the head 126 delivers a pair of cigarettes to an axially parallel flute in the periphery of a drum which moves the pairs of cigarettes sideways as indicated by arrow AA. This insures that the head 126 moves at a maximum speed during pick-up and at a minimum speed during delivery of pairs of cigarettes. The gears 161, 162 insure that the speed of the head 126 decreases gradually during movement from the pick-up station P toward the delivery station D and increases gradually during movement back to the pick-up station.

Each of the six carriers 127 of FIG. 4 supports a discrete head 126 and is coupled with a discrete orienting means 143. Furthermore, each carrier 127 can be rigid with a discrete gear 161 which, in turn, meshes with a discrete gear 162. The carriers 127 are shown as being located one behind the other but all of the heads 126 are located in a common plane. In the embodiment of FIG. 4, pairs of aligned carriers 127 are integral with each other so that the transfer apparatus can operate with three discrete elliptical gears 161 and three discrete elliptical gears 162. The angular spacing of the gears 161 and 162 with respect to each other corresponds to the angles between neighboring carriers 127.

The carriers 127 (as well as the carriers 27, 27A, 27B) are angularly movable with respect to each other about the axis of the shaft 128. Thus, each carrier 27 or 127 can be accelerated or decelerated with respect to the other carriers, depending on the momentary position of a roller follower 36 or the angular positions of complementary gears 161, 162.

All of the heads 26 or 126 can be located in a common plane by providing the respective orienting means 43, 143 with shafts 44 or 144 of different length. This renders it possible to employ a single pair of tracks 51, 52 or 151, 152.

FIG. 4 shows that the direction of movement of cigarettes is changed by 90°. Thus, a single file of cigarettes advances toward the pick-up station P by moving in the direction indicated by arrow A, and two rows of cigarettes leave the delivery station D by moving sideways in the direction indicated by arrow AA. However, the cigarettes at the station P are parallel to the cigarettes at the station D. The heads 126 travel along a circular path past the stations P and D while the carriers 127 rotate about the axis of the shaft 128.

As shown in FIG. 5, the transfer apparatus can be designed in such a way that the direction of sidewise movement of cigarettes 263 from the delivery station D is parallel to the direction of lengthwise movement of cigarettes toward the pick-up station P. A cigarette 263 which issues from the cigarette rod making machine Ma (arrow A) is engaged and retained by the head 226 on the carrier 227 of a transfer apparatus having a shaft 228. The orienting means for the head 226 is designed in such a way that the head 226 turns about the axis of the shaft 244 through 90° or 270° during travel from the station P to the station D. This can be achieved by appropriate selection of the configuration of cam means (not shown) for the roller follower or followers of the orienting means for the head 226. When the cigarette 263 is released at the delivery station D, it moves sideways (arrow A') whereby the direction if its sidewise movement in or toward the filter cigarette making machine Mb is parallel to the direction indicated by arrow A. The angular distance between the stations P and D of FIG. 5, as considered in the direction of movement of the head 226, is 180°.

An advantage of the transfer apparatus of FIG. 5 is that a production line including the machines Ma and Mb occupies less room than if the cigarettes 263 reaching the station D were to travel sideways at right angles to the direction of axial movement of cigarettes 263 in the machine Ma. Thus, the machines Ma and Mb can be installed one behind the other rather than at right angles to each other.

It is clear that the transfer apparatus of FIGS. 2–3, FIG. 4 or FIG. 5 can be designed to change the direction of movement of cigarettes by an oblique (obtuse or acute) angle rather than in a manner as shown in FIGS. 4 or 5.

FIGS. 6 to 8 illustrate a transfer apparatus which constitutes a modification of the apparatus of FIG. 5. All such parts of the transfer apparatus of FIGS. 6–8 which are identical with or clearly analogous to the corresponding parts of the apparatus of FIGS. 2–3 are denoted by similar reference characters plus 300.

The cigarettes 363 travel toward the pick-up station P by moving in the direction indicated by arrow A and are turned through 90° (i.e., from the plane of FIG. 6 to positions at right angles to such plane) during travel toward the delivery station D. At the station D, the cigarettes 363 are introduced into successive or selected receiving means or flutes 308*a* of a drum-shaped conveyor 308 in a filter cigarette making machine.

The carrier 327 is rotatable in a vertical plane about the axis of a horizontal shaft 328 and carries a radially outwardly extending shaft 344 for the pick-up device or head 326. Thus, the shaft 344 is normal to the shaft 328. The bell crank lever 334 is located in a vertical plane and its arm 332 carries a roller follower 336 tracking the peripheral surface of a stationary disk-shaped cam 338. The disk 329 is rotatable on or by the shaft 328 at a predetermined speed and is provided with a horizontal eccentric pin 331 for the bell crank lever 334. The arm 333 of the bell crank lever 334 is articulately coupled to the carrier arm 327 by a link 341.

The angular distance between the stations P and D is 90°. As stated before, a head 326 which moves from the station P toward the station D causes a cigarette 363 therein to turn through 90° (about the axis of the shaft 344) so that the cigarette can enter a flute 308*a* which is parallel to the axis of the shaft 328. The orienting means for turning the head 326 through 90° about the axis of the shaft 344 comprises a stationary cam 364 having an endless cam groove for a roller follower 366 provided on a shaft 367 at the free end of a lever 368 which is rigid with the head 326. For example, the head 326 and lever 368 may be rigid with the shaft 344 if the latter is rotatable in the outer end portion of the carrier 327. Thus, the head 326 (and a cigarette 363 therein) shares all angular movements of the lever 368 which is caused to pivot in response to movement of the roller follower 366 in the groove of the cam 364. The latter forms part of a cylindrical wall 369 of a frame member 371 which supports and may be rigid with one end of the shaft 328. The axial length of the wall 369 is sufficient to allow for the machining in its peripheral surface of an endless cam groove which causes the lever 368 to turn the shaft 344 through 90° during travel from the station P to the station D.

The operation of the transfer apparatus of FIGS. 6 to 8 is as follows:

The disk 329 receives motion from the prime mover of the cigarette rod making machine and rotates counterclockwise, as viewed in FIG. 6, normally at a constant speed. The pin 331 moves the bell crank lever 334 whereby the roller follower 336 tracks the peripheral surface of the cam 338 so that the carrier 327 is accelerated during movement toward the pick-up station P and is slowed down during movement from the station P toward the delivery station D. Thus, the head 326 moves at a maximum speed while it receives a single cigarette 363 (or several coaxial cigarettes) from the cigarette rod making machine at the station P, and the speed of the head 326 is reduced during travel toward the station D so that the transfer of cigarette into the oncoming flute 308*a* takes place without any deformation of the filler and/or wrapper of the article.

As the carrier 327 moves from the station P toward the station D, the roller follower 366 travels in a portion of the groove of the cam 364 which causes the lever 368 and shaft 344, with head 326 and cigarette 363 therein, to turn through 90° about the axis of the shaft 344 so that the orientation of the cigarette 363 with respect to the plane of FIG. 6 changes from parallel to normal.

It is clear that the transfer apparatus of FIGS. 6 to 8 can comprise two or more carriers 327 with an equal number of heads 326, shafts 344, levers 368, bell crank levers 334 and other parts which effect a change of speed while the heads travel from the station P toward the station D and back to the station P, as well as a change in orientation of the heads so that a cigarette which arrives at the station P by moving lengthwise leaves the station D by moving sideways.

An advantage of each of the heretofore described transfer apparatus is that cigarettes or analogous rod-shaped articles can be properly accepted by the head or heads of the transfer apparatus while moving lengthwise at a very high speed, and that such cigarettes can be delivered to an accepting conveyor or the like while moving sideways and at a speed which can be substantially or only slightly less than the speed of their lengthwise movement, depending upon the relative speeds of machines which respectively supply articles to the pick-up station and receive articles at the delivery station. As mentioned above, the improved transfer apparatus can be used with considerable advantage between a cigarette rod making machine which produces large quantities of plain cigarettes per unit of time (for example, up to and in excess of 70 plain cigarettes per second) and a filter cigarette making machine which normally receives pairs of coaxial plain cigarettes and wherein the speed of sidewise movement of such pairs of plain cigarettes is often substantially less than the speed of lengthwise or axial movement of cigarettes at the discharge end of the cigarette rod making machine.

Another important advantage of the improved transfer apparatus, especially of transfer apparatus using one or more bell crank levers as a means to change the speed of the carrier or carriers, is that the number of parts which are used to effect appropriate changes in the speed of heads during travel between the pick-up and delivery stations is small, that such parts are extremely simple, inexpensive, rugged and produce little noise, and that the cam (such as the cam 38 or 338) can be readily configurated with a view to achieve any practical change of speed during transport of articles from the pick-up station to the delivery station. Moreover, the transfer apparatus can be mounted in a vertical, horizontal or otherwise inclined plane to occupy space which is readily available in a production line, and the distance between the two stations can be selected at will (e.g., such distance may be 90°, 180° or 270°, as considered in the direction of orbital movement of the head or heads). Finally, the orientation of articles can be changed at will, for example, through 90° as described in connection with FIGS. 6–8, so that the axes of articles change their inclination with respect to the axis about which the carrier or carriers rotate during travel of articles from the station P to the station D or vice versa. As mentioned above, the change in orientation by 90° is but one of many possibilities of reorienting the articles on their way from a producing to a processing machine. The just described versatility of the transfer apparatus allows for such mounting of the two machines that they occupy a minimum of floor space or that they occupy floor space which is readily available in a tobacco processing plant.

Figure 9:
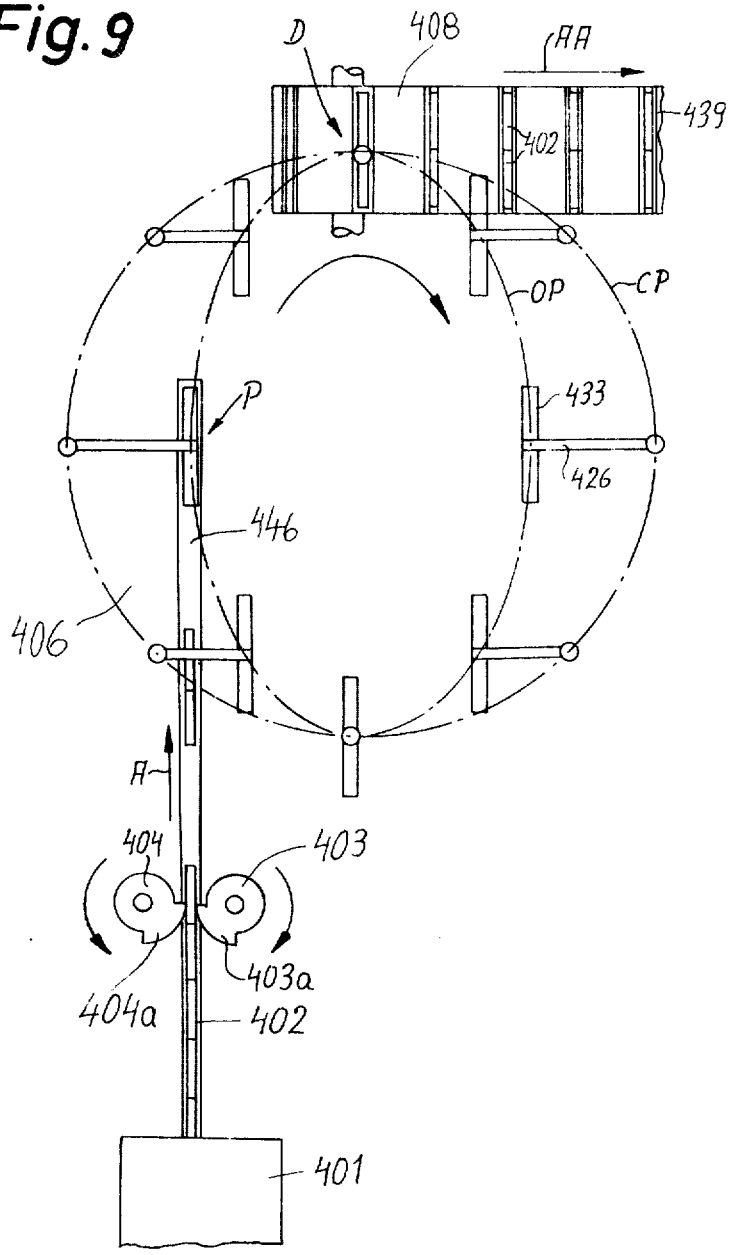
FIG. 9 is a schematic plan view of a fifth transfer apparatus.
Figure 10:
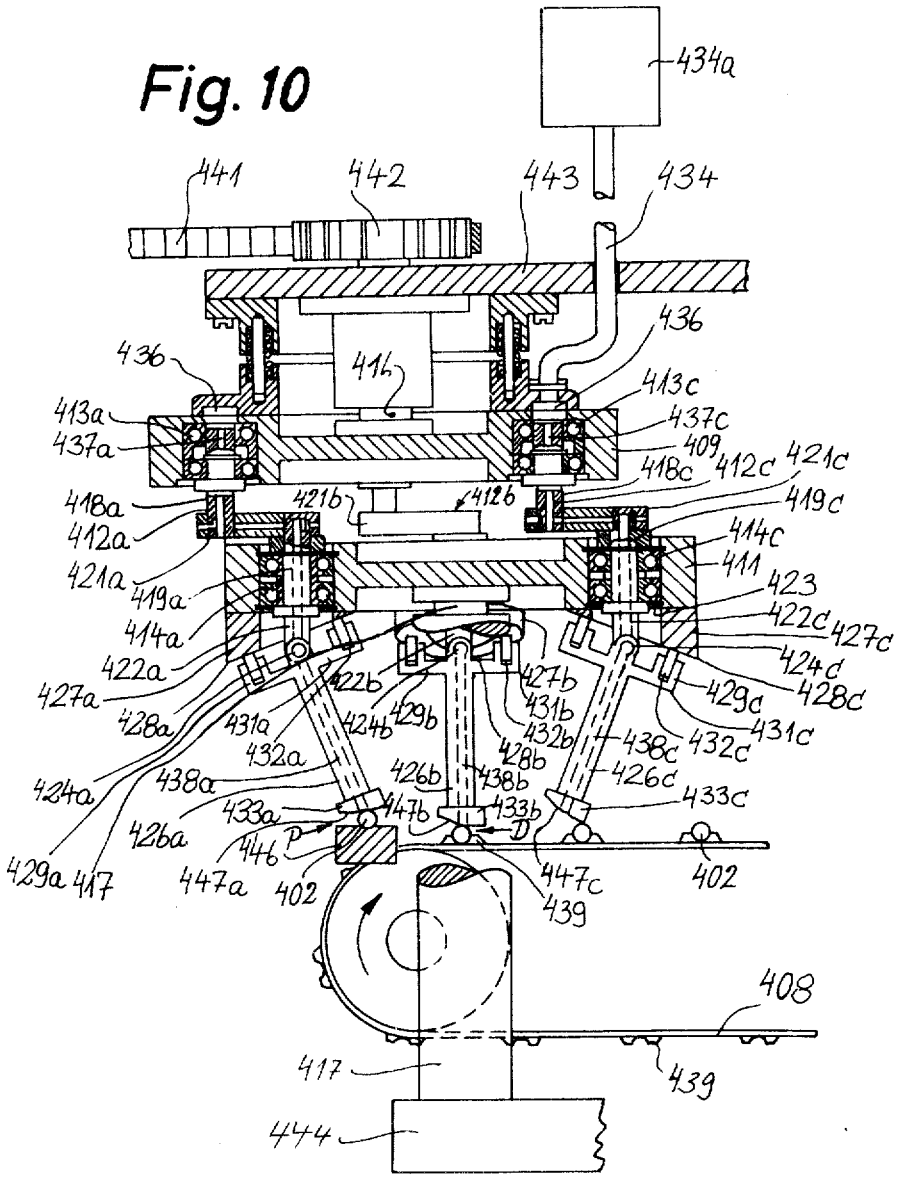
FIG. 10 is a vertical sectional view of the transfer apparatus of FIG. 9.

FIG. 9 is a schematic plan view of a portion of a cigarette rod making machine 401 which discharges a single file of plain cigarettes 402 and includes two cooperating accelerating cams 403, 404 serving to engage and accelerate each second cigarette 402 of the single file so that the accelerated cigarette propels the preceding cigarette and the two cigarettes enter simultaneously a pick-up station P to be accepted by an oncoming pick-up device or head 433 of a transfer apparatus 406 of the type shown in detail in FIG. 10. The heads 433 deposit pairs of cigarettes 402 into successive cradles 439 of a take-off conveyor 408 forming part of or serving to deliver pairs of coaxial plain cigarettes to a filter cigarette making machine. The delivery station is shown at D. The cigarette rod making machine 401 has an elongated guide or trough 446 wherein the single file of cigarettes 402 advances toward, past and beyond the accelerating cams 403, 404. In FIG. 9, the trough 446 extends to the pick-up station P and its front end is open so that it cah discharge cigarettes 402 into a suitable receptacle or onto a conveyor (not shown) if the transfer apparatus 406 is idle.

The accelerating cams 403, 404 are driven to rotate in opposite directions and have lobes 403*a*, 404*a* which can simultaneously engage the wrapper of each second cigarette 402. However, it is equally possible to construct the cams 403, 404 in such a way that the lobes 403*a*, 404*a* simultaneously engage the wrappers of two successive cigarettes 402 and propel such cigarettes toward the station P to thus insure that the oncoming head 433 of the transfer apparatus 406 has ample time to accept the freshly arrived pair of cigarettes prior to arrival of the next pair of cigarettes at the station P. The direction (arrow AA) in which the pairs of cigarettes 402 are moved sidewise by the respective cradles 439 of the conveyor 408 makes a right angle with the direction (arrow A) of lengthwise movement of cigarettes toward the pick-up station P.

Referring to FIG. 10, the transfer apparatus 406 comprises a rotary holder 409 which is operatively connected with and moves a turret 411. The operative connection between 409, 411 comprises at least four equally spaced coupling units or crank units including the illustrated crank units 412*a*, 412*b*, 412*c*. It is assumed that the operative connection includes four crank units 412, i.e., that the fourth crank unit is located in front of the crank unit 412*b* of FIG. 10.

The holder 409, the turret 411 and the four crank units 412 together constitute a twin parallel motion mechanism similar to that disclosed in German printed publication No. 1,632,213 to which reference may be had if necessary. Each of the crank units 412 has a first or upper crank pin (see 418*a*, 418*c*) which is rotatable in an antifriction bearing (see 413*a*, 413*c* in FIG. 10) mounted in the holder 409. Similar antifriction bearings (see 414*a*, 414*c*) are provided in the turret 411 for the second or lower crank pins (see 419*a*, 419*c*) of the crank units 412. The bearings 413 are located at equal distances from an upright vertical shaft 416 for the holder 409 which rotates in a horizontal plane. Analogously, the lower bearings 414 are located at the same distance from a vertical shaft 417 for the turret 411. Each crank unit 412 further comprises a horizontal crank arm (see 421*a*, 421*b*, 421*c*) which connects the respective upper crank pin 418 with the associated lower crank pin 419. The crank units 412 cause the turret 411 to turn about the axis of the shaft 417 in response to rotation of the holder 409 at a constant speed about the axis of the shaft 416. The orientation of the crank arms 412 remains unchanged while the holder 409 and turret 411 respectively rotate about the axes of the shafts 416, 417, i.e., it can be said that each of the crank arms 421 remains parallel to itself.

The lower crank pins 419 have downwardly extending stubs (see 422*a*, 422*b*, 422*c*) which project beyond the underside 423 of the turret 411 and are articulately connected with the upper end portions of downwardly extending carriers in the form of levers (see 426*a*, 426*b*, 426*c*). To this end, the stubs 422 carry horizontal coupling pins or pivot pins (see 424*a*, 424*b*, 424*c*) each of which allows the respective carrier or lever 426 to pivot in a predetermined vertical plane. The underside 423 of the turret 411 is formed or connected with cams (see 427*a*, 427*b*, 427*c*) having inclined cam faces for pairs of roller followers (see 432*a*, 432*b*, 432*c*) mounted in crossheads (see 431*a*, 431*b*, 431*c*) at the upper ends of the respective carriers or levers 426. Each of the cams 427 resembles a hollow cylinder having an inclined lower end face constituting a track for the respective roller followers 432, and each of these cams surrounds the respective stub 422. The lowermost portions (see 428*a*, 428*b*, 428*c*) of the lower end faces of the cams 427 are adjacent to the periphery of the turret 411, i.e., they are remotest from the axis of the shaft 417. Each of these lower end faces slopes upwardly toward the shaft 417, i.e., radially inwardly of the turret 411. The pairs of roller followers 432 form with the respective crossheads 431 tracking units (see 429*a*, 429*b*, 429*c*). Each crosshead 431 is normal or substantially normal to the longitudinal direction of the respective carrier or lever 426, and each of these crossheads may but need not be made of one piece with the respective lever 426. The uppermost portions of the roller followers 432 extend beyond the respective crossheads 431, and the length of each stub 422 is selected with a view to insure that the roller followers 432 invariably abut the inclined lower end faces of the respective cams 427. The cams 427 rotate with the turret 411 and the stubs 422 turn relative to the respective cams 427.

The lower end portions of the levers 426 carry pick-up heads (see 433*a*, 433*b*, 433*c*) which accept pairs of cigarettes 402 at the station P of FIG. 9 and transport such pairs of cigarettes to the cradles 439 at the delivery station D. In the embodiment of FIG. 10, the heads 433 are designed to attract pairs of aligned cigarettes 402 by suction. To this end, the transfer apparatus 406 comprises a fan or another suitable suction generating device 434A having an inlet which is connected to the upper end of a suction line 434. The lower end of the suction line 434 draws air from an arcuate channel 436 in the holder 409, and the channel 436 communicates with bores (see 437*a*, 437*c*) in the crank units 412. The bores 437 communicate with bores in pivot pins 424 and levers 426. The bores in the levers 426*a*–426*c* are respectively shown at 438*a*, 438*b* and 438*c*. Each head 433 has at least two suction ports which communicate with the respective bore 438 while a head 433 moves from the station P to the station D so that pairs of coaxial cigarettes 402 are attracted to the head during transport from the trough 446 to the conveyor 408. The length of the levers 426 is such that the heads 433 are immediately adjacent to pairs of cigarettes 402 at the pick-up station P and to oncoming cradles 439 at the delivery station D. The turret 411 and the crank units 412 constitute an orienting means which insures that the heads 433 are parallel to the cigarettes 402 at the stations P and D.

The operation:

The shaft 416 is rotated by the prime mover of the cigarette rod making machine 401 through the medium of an endless toothed belt 441 which drives a toothed pulley 442. The latter is rotatably mounted in the frame or housing 443 of the transfer apparatus 406 and rotates the shaft 416 with the holder 409. The crank units 412 drive the turret 411 so that the latter rotates in a horizontal plane about the axis of the shaft 417. The lower end portion of the shaft 417 (the median portion of which is broken away in FIG. 10) is mounted in a stationary bearing member 444 of the housing 443.

The turret 411 causes the upper end portions of the levers 426 to circulate about the shaft 417 and the stubs 422 and pivot pins 424 allow the levers 426 to move with respect to the turret 411 because the roller followers 432 of the units 429 track the inclined lower end faces of the respective cams 427. Each tracking unit 429 completes a revolution about the axis of the respective stub 422 in response to each revolution of the turret 411 about the axis of the shaft 417. The tracking of the lower end faces of cams 427 by the roller followers 432 results in pivoting of the heads 433 at the lower ends of the levers 426 toward and away from the shaft 417 so that, while the upper end portions of the levers 426 describe a circular path CP (shown in FIG. 9 by a phantom-line), the lower end portions of the levers 426 travel along an elliptical or oval path OP (also shown in FIG. 9 by a phantom-line). One of the two points where the paths CP and OP touch each other is at the delivery station D, and one of the points where the path CP is remotest from the path OP is at the pick-up station P. Thus, a lever 426 which reaches the delivery station D extends vertically downwardly because the respective roller followers 432 then track those portions of the inclined lower end face of the corresponding cam 427 which are located at a median distance from the underside 423 of the turret 411. On the other hand, a lever 426 which reaches the pick-up station P maintains its head 433 at a minimum distance from the axis of the shaft 417. The head 433 then registers with a pair of freshly arrived coaxial cigarettes 402 and attracts such cigarettes by suction so that the cigarettes are removed from the trough 446 and begin to advance (along the path OP) toward the delivery station D. The inclination of the lever 426 whose head 433 carries a freshly received pair of cigarettes 402 changes and the lever is vertical at the time its head 433 reaches the station D where the cigarettes 402 descend into the oncoming cradle 439 of the conveyor 408. The speed of the head 433 decreases during movement from the station P toward the station D because the speed of pivotal movement of the lever 426 is subtracted from the speed of angular movement of the turret 411. On the other hand, the speed of the head 433 increases during movement from the station D toward the 3 o'clock position of FIG. 9; such speed thereupon decreases again during movement from the 3 o'clock position to the 6 o'clock position, and increases again to a maximum speed upon completion of movement from the 6 o'clock position to the pick-up station P. The rotational speed of the turret 411 about the axis of the shaft 417 and the speed of pivotal movement of each lever 426 about the respective pivot pin 424 can be readily selected in such a way that the heads 433 move at the speed of cigarettes 402 (arrow A) during movement past the station P, and that the heads move at a lower speed (corresponding to the speed of cradles 439 on the conveyor 408) and in the direction of arrow AA during movement past the delivery station D. It can be said that the speed of the turret 411 determines the speed of movement of a head 433 at the station P, and that the inclination of the lower end faces of cams 427 plus the length of the levers 426 determines the speed of heads 433 at the delivery station D.

The heads 433 are formed with suitably inclined bottom surfaces (see 447*a*, 447*b*, 447*c* in FIG. 10) which insure that the heads cannot touch the trough 446 even if they pivot inwardly beyond the positions shown for the heads 433*a*, 433*c* of FIG. 10. The pick-up station P is adjacent to one end of the minor axis and the delivery station D is adjacent to one end of the major axis of the elliptical path OP.

Figure 11:
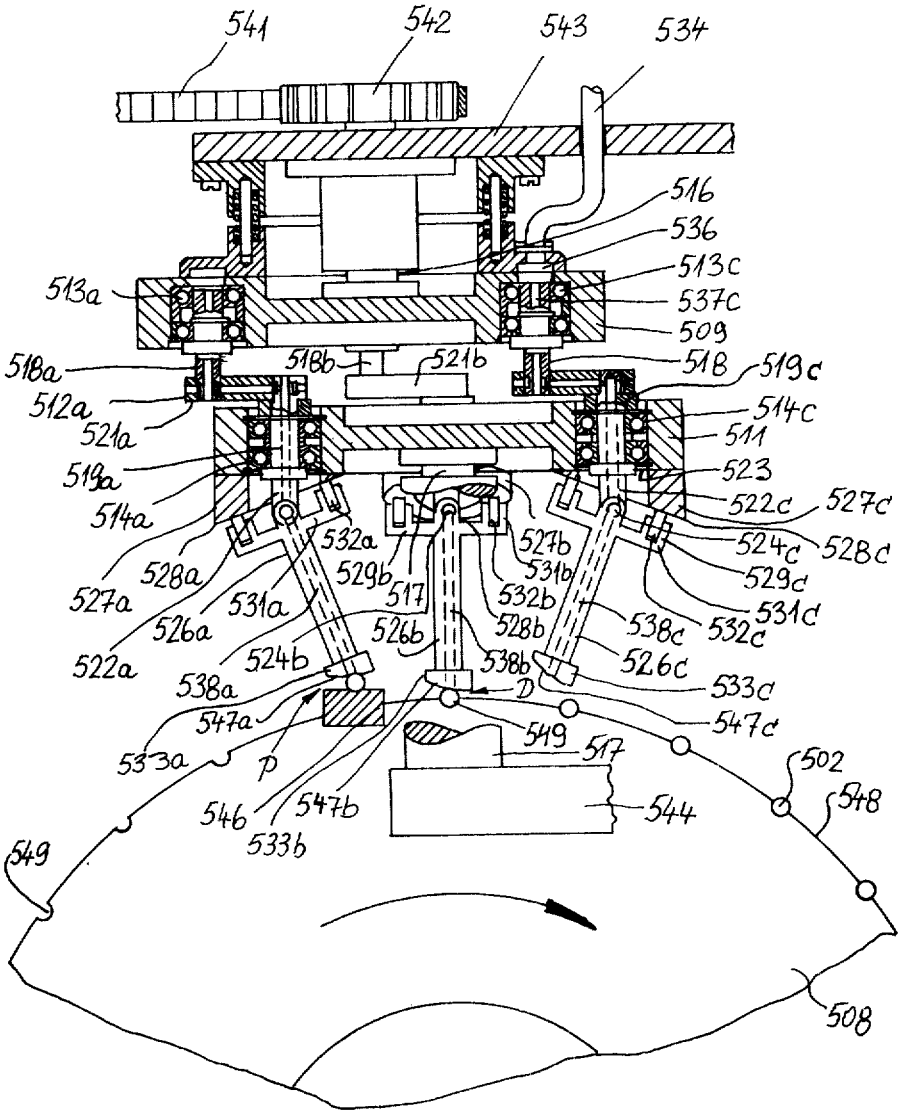
FIG. 11 is a similar vertical sectional view of a transfer apparatus which constitutes a first modification of the apparatus of FIGS. 9–10.

FIG. 11 illustrates a portion of a transfer apparatus which constitutes a modification of the apparatus shown in FIGS. 9–10. All such parts of the apparatus of FIG. 11 which are identical with or clearly analogous to the corresponding parts of the apparatus of FIGS. 9–10 are denoted by similar reference characters plus 100.

The take-off conveyor 508 of FIG. 11 is a drum having axially parallel peripheral flutes 549 for reception of cigarettes 502 from the pick-up devices or heads (see 533*a*, 533*b*, 533*c*) of the carriers or levers 526. The flutes 549 are machined into the peripheral surface 548 of the drum 508 and a flute 549 arrives at the delivery station D when the respective lever 526 is substantially vertical, i.e., when the corresponding head (533*b* in FIG. 11) is located at a maximum distance from the shaft 517 for the turret 511 of the orienting means. The corresponding roller followers 532*b* then track those portions of the lower end face of the respective cam 527*b* which are located at a median distance from the underside 523 of the turret 511.

FIG. 11 further shows that a head (533*a*) which is about to receive one or more cigarettes 502 from the trough 546 is located at a minimum distance from the shaft 517 because one of the corresponding roller followers 532*a* then tracks the lowermost portion 528*a* of the lower end face of the respective cam 527*a*. The inclined bottom surface 547*a* of the head 533*a* is then immediately adjacent or sufficiently close to the cigarette or cigarettes 502 at the pick-up station P to attract such cigarette or cigarettes by suction and to begin the transfer of cigarette or cigarettes toward the delivery station D.

Suction in the ports of the heads 433 or 533 can be terminated automatically at the delivery station D of FIGS. 9 or 11, for example, as a result of movement of the respective lever 426 or 526 to a vertical position. It is also possible to provide suction ports in the flutes 549 and to connect such ports with a suction generating device which is strong enough to insure automatic retention of cigarettes 502 in the flutes 549 at the delivery station D of FIG. 11. The drum 508 is assumed to rotate clockwise, as viewed in FIG. 11.

Figure 12:
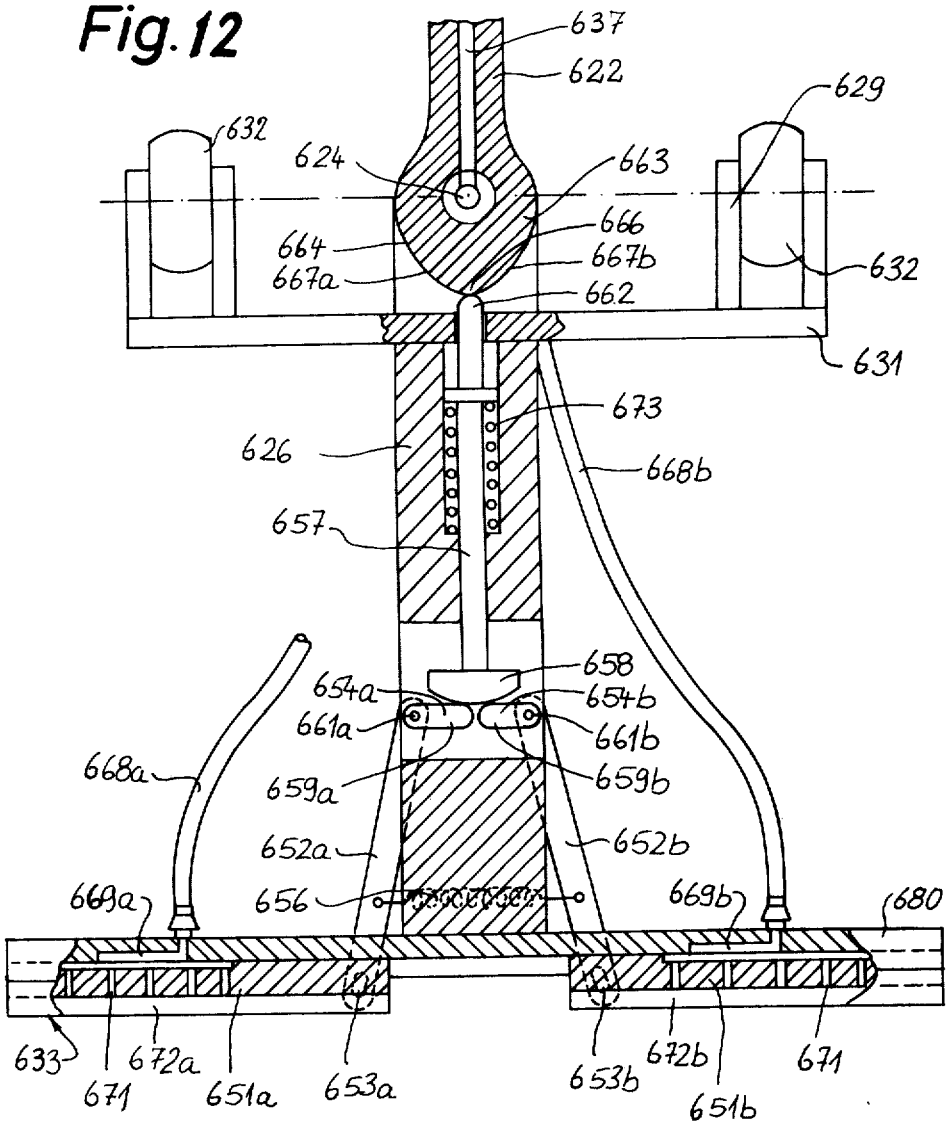
FIG. 12 is an enlarged vertical sectional view of a detail in a transfer apparatus which constitutes a second modification of the apparatus of FIGS. 9–10.

FIG. 12 shows the lower portion of a further transfer apparatus wherein all such parts which are identical with or clearly analogous to the corresponding parts of the apparatus of FIGS. 9–10 are denoted by similar reference characters plus 200. The carrier or lever 626 of FIG. 12 carries at its lower end a pick-up device or head 633 which comprises two pick-up sections or halves 651*a* and 651*b*. The sections 651*a*, 651*b* are respectively coupled to the lever 626 by links 652*a*, 652*b* having at their lower ends elongated slots for coupling pins 653*a*, 653*b*. The upper end portions of the links 652*a*, 652*b* are respectively connected to the lever 626 by horizontal pivot pins 661*a*, 661*b* and are rigid with inwardly extending arms 654*a*, 654*b* located in the path of movement of a ram 658. The latter is mounted at the lower end of a shank or rod 657 which is reciprocable in an axial bore of the lever 626 and is biased upwardly, as viewed in FIG. 12, by a helical spring 673 which reacts against an internal shoulder of the lever 626 and bears against a collar of the shank 657. The median portions of links 652*a*, 652*b* are connected to each other by a helical spring 656 which tends to move the sections 651*a*, 651*b* toward each other and to respectively pivot the arms 654*a*, 654*b* counterclockwise and clockwise, as viewed in FIG. 12. Each of the links 652*a*, 652*b* constitutes with the respective arm 654*a*, 654*b* one of two mirror symmetrical bell crank levers 659*a*, 659*b*.

The crosshead 631 of the lever 626 shown in FIG. 12 forms part of a tracking unit 629 which further includes two roller followers 632 tracking the inclined lower end face of a cam corresponding to a cam 427 or 527. The central portion of the crosshead 631 has a bore for the upper end portion 662 of the rod 657 which abuts against the peripheral surface of a shifting cam 663 provided on the stub 622 of the respective lower crank pin (not shown in FIG. 12). The cam face 664 of the shifting cam 663 has a lobe 666 which is engaged by the end portion 662 of the rod 657 in vertical position of the lever 626 whereby the ram 658 pivots the arms 654*a*, 654*b* to move the aligned pick-up sections 651*a*, 651*b* of the composite head 633 away from each other. The coupling pin 624 for the upper end portion of the lever 626 is mounted in the shifting cam 663. The configuration of the cam face 664 determines the extent of reciprocatory movement of sections 651*a*, 651*b* toward and away from each other in response to pivoting of the lever 626 about the axis of the pin 624. The lobe 666 of the cam face 664 is flanked by two surface portions 667*a*, 667*b* along one of which the upper end portion 662 of the rod 657 moves when the lever 626 is caused to leave the vertical position shown in FIG. 12. The spring 656 is then free to contact and to move the sections 651*a*, 651*b* toward each other because the spring 673 moves the ram 658 upwardly to the extent permitted by the cam 663.

The bore 637 of the stub 622 is connected with a suction line (such as the suction line 434 of FIG. 10) and communicates with two flexible hoses 668*a*, 668*b* which are coupled to a guide rail 680 for the sections 651*a*, 651*b*. The guide rail 680 forms part of the head 633 and is rigid with the lower end portion of the lever 626. The hoses 668*a*, 668*b* respectively draw air from two manifolds 669*a*, 669*b* in the rail 680, and the manifolds respectively communicate with suction ports 671 in the sections 651*a*, 651*b*, at least in certain positions of these sections with respect to the rail 680. The undersides of the sections 651*a*, 651*b* are provided with elongated grooves or flutes 672*a*, 672*b* each of which can receive a portion of a cigarette, not shown.

The operation of the transfer apparatus which includes the structure of FIG. 12 is as follows:

When the roller followers 632 track the inclined lower end face of the associated cam (such as a cam 427 or 527), the carrier or lever 626 pivots about the axis of the coupling pin 624 and its ram 658 moves up or down, depending on the position of the end portion 662 of the rod 657 with respect to the face 664 of the cam 663. When the end portion 662 engages the lowermost point of the lobe 666, the ram 658 maintains the sections 651*a*, 651*b* of the head 633 at a maximum distance from each other so that the cigarettes in such sections are spaced apart when they arrive at the delivery station and enter a cradle 439 or a flute 549 in such positions with respect to each other that they provide room for insertion of a filter plug therebetween. Such filter plug is preferably of double unit length so that it can be assembled with two plain cigarettes of unit length into a filter cigarette of double unit length which is thereupon severed midway between its ends to yield two filter cigarettes of unit length in a manner customary in the making of filter cigarettes.

When the lever 626 pivots to the right or to the left, as viewed in FIG. 12, the end portion 662 of the rod 657 engages the portion 667*b* or 667*a* of the cam face 664 whereby the rod 657 moves upwardly under the action of the spring 673 and the spring 656 is free to contract so as to move the sections 651*a*, 651*b* closer to each other during movement toward the pick-up station. The flutes 672*a*, 672*b* are then in a position to engage and transport two closely adjacent plain cigarettes which are moved away from each other as the lever 626 pivots back toward the upright position of FIG. 12, i.e., the cigarettes in the flutes 672*a*, 672*b* are moved apart but remain aligned with each other while the head 633 travels from the pick-up station toward the delivery station. Suction in the manifolds 669*a*, 669*b* can be terminated automatically when the lever 626 assumes the position of FIG. 12, for example, by providing the crosshead 631 with a valve member (not shown) which seals the bore 637 from the hoses 668*a*, 668*b* when the end portion 662 of the rod 657 bears against the tip of the lobe 666 on the face 664 of the cam 663.

The transfer apparatus of FIGS. 9–10, 11 or 12 are particularly suited for transfer of cigarettes or analogous rod-shaped articles which are being fed to the pick-up station at a very high speed. The speed of the turret (such as 411 or 511) can be readily selected in such a way that the heads reach the pick-up station while moving at the exact speed of lengthwise movement of articles at the pick-up station or while the heads move at a speed which is very close to the speed of movement of articles so that the articles can be taken over with a high degree of reliability and without any deformation of their fillers and/or wrappers.

The transfer apparatus of FIGS. 9–10, 11 and 12 can further reduce the speed of the heads 433, 533 or 633 during transport from the pick-up station to the delivery station so that the speed of articles at the delivery station equals or closely approximates the speed of flutes, cradles or other suitable receiving means on the take-off conveyor which moves the articles sideways. All that is necessary is to provide the cams (such as 427 and 527) for the levers or carriers with suitably inclined end faces, i.e., to select the extent of pivotal movement of the levers during movement from the pick-up station to the delivery station. As a rule, the speed of articles which arrive at the delivery station will equal or slightly exceed the speed of movement of the take-off conveyor.

The transfer apparatus which embodies the structure of FIG. 12 (and which preferably comprises several levers 626 and heads 633, the same as described in connection with FIGS. 9–10 and 11) exhibits the additional advantage that it can automatically move the articles of a pair of coaxial articles away from each other so as to provide between the spaced-apart coaxial articles gaps of desired width. As mentioned above, this is particularly desirable in a production line wherein plain cigarettes issuing from a cigarette rod making machine are being processed in a filter cigarette making machine. Such spreading of plain cigarettes contributes to simplicity of the filter cigarette making machine which need not be provided with cams or other means for moving the plain cigarettes of each pair of aligned cigarettes away from each other, or to simplicity of the cigarette rod making machine which need not be provided with complex means for assembling plain cigarettes into pairs of coaxial cigarettes which are spaced apart to the extent necessary for processing in the filter cigarette making machine.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended:

1. Apparatus for transferring cigarettes or analogous rod-shaped articles between first and second stations where the articles respectively move lengthwise in a single file and sideways in at least one row, comprising means for feeding articles to one of said stations; article-receiving means at the other of said stations; a carrier rotatable about a predetermined axis; a pick-up device rotatable relative to said carrier about a second axis located at a fixed distance from said predetermined axis to travel past said stations along a circular path in response to rotation of said carrier; orienting means for rotating said device relative to said carrier while the carrier rotates to thereby respectively align said device with at least one article at said one station and with said receiving means at said other station so that said device can pick up articles at said one station and deliver the picked up articles to said receiving means at said other station; and means for rotating said carrier at a plurality of speeds including first and second speeds while said device respectively travels past said first and second stations, including a rotary driving member, means for normally driving said member at a constant speed, and means for driving said carrier at a plurality of speeds in response to rotation of said driving member at said predetermined speed.

2. Apparatus as defined in claim 1, wherein the articles at said first station are parallel to the articles at said second station and said orienting means is arranged to maintain said pick-up device in parallelism with said articles in all angular positions of said carrier.

3. Apparatus as defined in claim 1, wherein said circular path is located in a substantially horizontal plane.

4. Apparatus as defined in claim 1, wherein said pick-up device is rotatable with respect to said carrier about a second axis which is parallel to said predetermined axis and said orienting means comprises at least one follower connected with said pick-up device and spaced apart from said second axis, and an endless track for said follower.

5. Apparatus as defined in claim 1, wherein said pick-up device is rotatable about a second axis parallel to said predetermined axis and said orienting means comprises a plurality of followers connected with said device and discrete endless tracks for said followers.

6. Apparatus as defined in claim 1, wherein said carrier has two arms, said pick-up device being movably mounted on one of said arms and further comprising a second pick-up device movably mounted on the other of said arms.

7. Apparatus as defined in claim 1, wherein said carrier is an arm having a first end portion rotatable about said predetermined axis and a second end portion rotatably supporting said pick-up device.

8. Apparatus as defined in claim 1, wherein said circular path is located in a substantially vertical plane.

9. Apparatus as defined in claim 8, wherein said pick-up device is rotatable on said carrier about a second axis which is substantially normal to said predetermined axis, said orienting means being arranged to rotate said device about said second axis.

10. Apparatus as defined in claim 9, wherein said orienting means comprises a fixed cam and a follower connected with said pick-up device and tracking said cam in response to rotation of said carrier.

11. Apparatus as defined in claim 1, further comprising at least one additional carrier rotatable about said predetermined axis, a pick-up device movably mounted on said additional carrier, orienting means for the pick-up device on said additional carrier, and means for rotating said additional carrier at said plurality of speeds independently of said first mentioned carrier.

12. Apparatus as defined in claim 11, wherein said carriers are staggered with respect to each other, as considered in the direction of said predetermined axis, and are rotatable in parallel planes about said predetermined axis.

13. Apparatus as defined in claim 1, wherein said means for rotating said carrier comprises a plurality of mating elliptical gears.

14. Apparatus as defined in claim 13, wherein said gears include a first gear rigid with said carrier and a second gear mating with said first gear, said means for rotating said carrier further comprising means for driving said second gear at a predetermined speed.

15. Apparatus as defined in claim 13, further comprising a second carrier, a second pick-up device movably mounted on said second carrier, orienting means for said second device, and means for rotating said second carrier about said axis at said plurality of speeds independently of said first carrier, including a plurality of mating elliptical gears.

16. Apparatus for transferring cigarettes or analogous rod-shaped articles between first and second stations where the articles respectively move lengthwise in a single file and sideways in at least one row, comprising means for feeding articles to one of said stations; article-receiving means at the other of said stations; a carrier rotatable about a predetermined axis; a pick-up device movably mounted on said carrier at a point remote from said axis to travel past said stations along a circular path in response to rotation of said carrier; orienting means for moving said device relative to said carrier while the carrier rotates to thereby respectively align said device with at least one article at said one station and with said receiving means at said other station so that said device can pick up articles at said one station and deliver the picked up articles to said receiving means at said other station; and means for rotating said carrier at a plurality of speeds including first and second speeds while said device respectively travels past said first and second stations, including a driving member rotatable about said predetermined axis, means for driving said member at a constant speed, and means for driving said carrier at said plurality of speeds in response to rotation of said driving member at said constant speed, said means for driving said carrier including a motion transmitting unit eccentrically mounted on said driving member and connected with said carrier and means for moving said motion transmitting unit relative to said driving member to thereby rotate said carrier relative to said driving member while said carrier rotates about said predetermined axis.

17. Apparatus as defined in claim 16, wherein said motion transmitting unit comprises a lever pivotably mounted on said driving member and said means for moving said motion transmitting unit relative to said driving member comprises a cam having a portion tracked by a follower of said unit.

18. Apparatus as defined in claim 17, wherein said lever has a first arm supporting said follower and a second arm, said motion transmitting unit further comprising a link articulately connecting said second arm with said carrier.

19. Apparatus for transferring cigarettes or analogous rod-shaped articles between first and second stations where the articles respectively move lengthwise in a single file and sideways in at least one row, comprising means for feeding articles to one of said stations; article-receiving means at the other of said stations; a carrier rotatable about a predetermined axis; a pick-up device mounted on said carrier for rotation about axis parallel to said predetermined axis to travel past said stations along a circular path in response to rotation of said carrier; orienting means for rotating said device relative to said carrier while the carrier rotates to thereby respectively align said device with at least one article at said one station and with said receiving means at said other station so that said device can pick up articles at said one station and deliver the picked up articles to said receiving means at said other station, comprising a plurality of followers connected with said device and discrete endless tracks for said followers, said tracks having overlapping portions; and means for rotating said carrier at a plurality of speeds including first and second speeds while said device respectively travels past said first and second stations.

20. Apparatus for transferring cigarettes or analogous rod-shaped articles between first and second stations where the articles respectively move lengthwise in a single file and sideways in at least one row, comprising means for feeding articles to one of said stations; article-receiving means at the other of said stations; a holder rotatable about a first axis in a plane substantially normal to said axis; at least one carrier having a first end portion and a second end portion and being movable by said holder so that said first end portion performs a circular movement; coupling means mounting said first end portion of said carrier for pivotal movement about a second axis which is parallel to said plane and is located at a fixed distance from the center of the circle along which said first end portion moves in response to rotation of said holder; a pick-up device on the second end portion of said carrier; means for rotating said holder at a predetermined speed; means for pivoting said carrier about said second axis in synchronism with rotation of said holder to thereby move said device along an endless path extending past said first and second stations; and orienting means for maintaining said device in parallelism with at least one article at said one station so that said device can pick up articles at said one station and deliver the picked up articles to said receiving means at said other station.

21. Apparatus as defined in claim 20, wherein said means for pivoting said carrier about said second axis comprises a cam and means for rotating said cam relative to said carrier.

22. Apparatus as defined in claim 20, wherein said operating means comprises a turret rotatable about a third axis which is parallel to said first axis and a crank unit coupling said turret to said holder so that said turret rotates in response to rotation of said holder, said crank unit having a crank pin rotatably mounted in said turret and said coupling means connecting said one end portion of said carrier to said crank pin so that said carrier can pivot relative to but rotates with said crank pin.

23. Apparatus as defined in claim 22, wherein said crank unit comprises a second crank pin rotatable in said holder and a crank arm connecting said crank pins.

24. Apparatus as defined in claim 23, wherein said means for pivoting includes a cam provided on said turret.

25. Apparatus as defined in claim 24, wherein said cam has an inclined cam face and said means for pivoting further comprises follower means mounted on said carrier and tracking said cam in response to rotation of said turret.

26. Apparatus as defined in claim 25, wherein said follower means includes a plurality of roller followers.

27. Apparatus as defined in claim 25, wherein said turret is rotatable in a second plane and said cam face is inclined with respect to said second plane radially of said second axis.

28. Apparatus as defined in claim 20, wherein said pick-up device has at least one suction port to attract articles at said one station and further comprising suction generating means and means for connecting said port with said suction generating means.

29. Apparatus as defined in claim 28, wherein said connecting means includes a bore in said carrier.

30. Apparatus as defined in claim 20, wherein said one station is said first station and said pick-up device is dimensioned to pick up a plurality of axially aligned articles during movement past said first station.

31. Apparatus as defined in claim 30, further comprising means for moving the articles picked up by said device at said first station axially of and away from each other in response to movement of said device from said first toward said second station.

32. Apparatus as defined in claim 31, wherein said device comprises two aligned pick-up sections which are movable toward and away from each other and said means for moving the articles away from each other includes means for moving said sections toward each other in response to movement of said device toward said first station and away from each other in response to movement of said device from said first to said second station.

33. Apparatus as defined in claim 20, wherein said endless path is an elliptical path wherein said device moves at a maximum speed in the region of the minor axis and at a minimum speed in the region of the major axis of said path.

34. Apparatus as defined in claim 33, wherein said other end portion of said carrier is located at a level below said one end portion thereof.

35. Apparatus as defined in claim 33, wherein said plane is a horizontal plane and said one station is adjacent to the minor axis of said elliptical path.

* * * * *